US011230396B2

(12) United States Patent
Koet et al.

(10) Patent No.: US 11,230,396 B2
(45) Date of Patent: Jan. 25, 2022

(54) SYSTEM AND METHOD FOR FORMING BOXES FROM CARDBOARD BLANKS

(71) Applicant: Neopost Technologies B.V., Bagneux (FR)

(72) Inventors: Anne Koet, Drachten (NL); Age Miedema, Drachten (NL)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 119 days.

(21) Appl. No.: 16/729,963

(22) Filed: Dec. 30, 2019

(65) Prior Publication Data

US 2020/0207491 A1 Jul. 2, 2020

(30) Foreign Application Priority Data

Dec. 30, 2018 (DE) ..... 10 2018 133 710.8

(51) Int. Cl.
*B65B 5/02* (2006.01)
*B31B 50/00* (2017.01)
(Continued)

(52) U.S. Cl.
CPC ..... *B65B 5/024* (2013.01); *B31B 50/004* (2017.08); *B31B 50/005* (2017.08);
(Continued)

(58) Field of Classification Search
CPC ..... B31B 50/741; B31B 50/52; B31B 50/042; B31B 50/005; B31B 50/626;
(Continued)

(56) References Cited

U.S. PATENT DOCUMENTS 2,977,861 A * 4/1961 Gibb ..... B31B 50/00 493/171
3,513,757 A * 5/1970 Di Frank ..... B65H 1/06 493/131

(Continued)

FOREIGN PATENT DOCUMENTS

EP 0983940 A1 3/2000
WO 2014117817 A1 8/2014

(Continued)

OTHER PUBLICATIONS

Extended European Search Report for EP 19219966.9, dated Jun. 2, 2020, 7 pages.

(Continued)

*Primary Examiner* — Thomas M Wittenschlaeger
(74) *Attorney, Agent, or Firm* — Cozen O'Connor

(57) ABSTRACT

A system for automatically forming packaging boxes comprises a folding station comprising four folding units adapted to fold panels of cardboards blanks to form substantially cuboid boxes or lids or combinations of a box and a lid, some of said panels in the folded state forming pairs of two panels running substantially parallel to each other in a processing direction, in which the blanks are transported through the system, and orthogonal to a width direction of the blanks, which is the orthogonal direction to the processing direction in the plane of the blanks, one or more glue application units adapted to put glue on at least one panel of each of said pairs of two panels, a feeding conveyor to convey a cardboard blank into the folding station, a curing station adapted to take over the boxes or lids or combinations of a box and a lid folded in the forming station from the folding station, said curing station comprising holding structure to form-fittingly hold said pairs of panels and to
(Continued)

guide the boxes or lids or combinations of a box and a lid through the curing station.

9 Claims, 8 Drawing Sheets

(51) Int. Cl.

| | |
|---|---|
| ***B31B 50/04*** | (2017.01) |
| ***B31B 50/52*** | (2017.01) |
| ***B31B 50/62*** | (2017.01) |
| ***B31B 50/74*** | (2017.01) |
| ***B65B 43/10*** | (2006.01) |
| *B31B 100/00* | (2017.01) |
| *B31B 110/35* | (2017.01) |
| *B31B 120/10* | (2017.01) |

(52) U.S. Cl.
CPC ..... *B31B 50/042* (2017.08); *B31B 50/52* (2017.08); *B31B 50/624* (2017.08); *B31B 50/741* (2017.08); *B65B 43/10* (2013.01); *B31B 2100/0024* (2017.08); *B31B 2110/35* (2017.08); *B31B 2120/10* (2017.08); *B65B 2210/04* (2013.01)

(58) Field of Classification Search
CPC ..... B31B 50/624; B31B 50/004; B31B 2100/0024; B31B 2120/10; B31B 2110/35; B65B 5/024; B65B 43/10; B65B 59/001; B65B 11/004; B65B 2210/04
See application file for complete search history.

(56) References Cited

U.S. PATENT DOCUMENTS 3,541,930 A * 11/1970 Goodrich ..... B31B 50/00 493/126
3,585,776 A * 6/1971 Euwe ..... B65B 11/004 53/447
4,067,172 A * 1/1978 Paules ..... B65B 59/00 53/53
6,170,231 B1 * 1/2001 Detterman ..... B65B 5/024 53/207
6,267,715 B1 * 7/2001 Sass ..... B31B 50/00 493/119
6,357,212 B1 * 3/2002 Salm ..... B65B 51/023 53/558
8,092,360 B2 * 1/2012 Greenfield ..... B65D 5/0281 493/162
8,282,537 B2 * 10/2012 Gebhardt ..... 493/70
9,434,496 B2 * 9/2016 Sytema ..... B65B 59/001
9,962,895 B2 * 5/2018 Ponti ..... B65B 59/001
10,093,438 B2 * 10/2018 Pettersson ..... B65B 59/001
10,155,352 B2 * 12/2018 Sytema ..... B31B 50/52
10,543,945 B2 * 1/2020 Sytema ..... B65B 5/024
10,583,943 B2 * 3/2020 Feijen ..... B65B 5/02
2008/0020916 A1 * 1/2008 Magnell ..... G01B 11/043 493/65
2009/0233777 A1 * 9/2009 Greenfield ..... B65D 5/0281 493/52
2012/0298731 A1 * 11/2012 Hargreaves ..... B65D 3/22 229/100
2014/0031188 A1 * 1/2014 Janse Van Rensburg ..... B31B 50/00 493/309
2015/0360433 A1 * 12/2015 Feijen ..... B31B 50/74 53/456
2015/0367974 A1 * 12/2015 Sytema ..... B65B 57/12 53/461

FOREIGN PATENT DOCUMENTS

WO 2014118629 A2 8/2014
WO 2016059218 A1 4/2016
WO 2019081773 A1 5/2019

OTHER PUBLICATIONS

International Fibreboard Case Code, published by FEFCO and ESBO, 2007, 11th edition.

* cited by examiner

SYSTEM AND METHOD FOR FORMING BOXES FROM CARDBOARD BLANKS

TECHNICAL FIELD OF THE INVENTION

The invention relates to a system and a method for forming boxes, in particular custom-sized boxes, from cardboard blanks as in particular used in systems for automatically packaging shipment sets, i.e. sets of one or more items to be shipped, in particular varying shipment sets, in which at least the number, usually the number and the size of the items vary. The invention also relates to a system and a method for automatically packaging varying shipment sets in custom-sized cardboard boxes.

TECHNICAL BACKGROUND

Mail ordering has become a widely used way of buying goods. More and more companies offer virtual department stores, in which the customers can electronically put goods in a shopping cart that later will be transferred by the respective company into a dispatch order so that in a warehouse a shipment set comprising the items ordered (and sometimes additional items such as samples, vouchers, invoices, void-fill etc.) can be assembled based on the respective dispatch order.

While assembling a shipment set in a warehouse of a specialized distributor is nowadays often done fully automated, packaging the shipment set is still a challenge, in particular when a shipment set comprises several items of different sizes and in different quantities. Often, the items to be packaged are provided automatically to a person packaging the items manually. Depending on the size and number of the items, the person selects a suitable box size.

To automate the packaging process even in cases where the items forming a shipment set vary in size and number, different systems have been proposed. One approach is shown in WO 2016/059218 A1, which discloses a system and a method for automatically packaging varying shipment sets, which system and method employ two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

A different approach is shown in WO 2014/118629 A2 and WO 2014/117817 A1, which teach methods and systems that allow—within the boundaries imposed by the material used—creating a fully custom-sized box, i.e. a cuboid box, of which width, length and height are adapted to the respective content of the box.

Such systems create boxes by first obtaining information on the outer dimensions length, width and height of the shipment set to be packaged and calculating based on this information the layout of a custom-sized cardboard blank (sometimes called template or piano) comprising different so called panels, which are delimited from each other by crease lines or indentations and incisions allowing the panels to be folded in order to create the box wanted. A piece of cardboard supplied from a roll of cardboard or a stack of zig-zag cardboard is then cut-off, intended and incised (not necessary in this order) to form the blank. Depending on the specific way the system works, a box with or without an attached lid may then be formed by gripping and folding the blank.

The "International Fibreboard Case Code" published by FEFCO and ESBO, 2007, 11th edition, discloses under item 0300 a box (hereinafter referred to as "type 0300" box), which is very stable and yet very easy to manufacture as the layout of the corresponding blank, from which the box is folded, is rather simple. Each box comprises a rectangular bottom panel having four edges, a first and a second rectangular end panel, each joined over a crease line to opposite edges of said bottom panel, a first and a second rectangular side panel, each joined over a crease line to opposite edges of said bottom panel, two first and two second rectangular corner panels, the first corner panels joined over respective crease lines to opposite edges of the first end panel, and the second corner panels joined over respective crease lines to opposite edges of the second end panel. In the following, as the blank is moved in a transport direction through a system for automatically forming custom-sized boxes, the first end panel is also called front end panel and the respective first corner panels attached to it are called front corner panels, as these panels form the front of a blank moving through the system, while the second end panel is called for the corresponding reason the rear end panel, and the second corner panels attached to it are called rear corner panels.

It should be noted that due to the thickness of the cardboard, the so-called crease lines are not thin lines as for folding paper, but are rather "crease grooves". However, following the terminology common in the art, the term crease line is used herein.

It should be also noted that the term "width of the bottom panel" as used herein refers to the extension of the bottom panel in the direction of the width of the cardboard supplied for making the box, and "length of the bottom panel" refers to extension in the direction of the length of the cardboard supplied, which is also the direction, in which the cardboard is transported into and inside a system for creating custom-sized boxes. Seen in this transport direction, the end panels of the box are in front and behind the bottom panel, while the side panels of the box are to the left and the right of said bottom panel. The term "outer dimensions" refers to the dimensions of the panels on the outside of the erected box.

The boxes can be closed for example with a lid having the same structure, i.e. a lid with corner panels, or with a lid having an even simpler blank layout in which the corner panels are cut away similar to the lid shown under item 0302 in said FEFCO/ESBO publication ("type 0302" lid). Such lid comprises a rectangular top panel having four edges, a first and a second rectangular end panel, joined to opposite edges of said top panel, a first and a second rectangular side panel joined to opposite edges of said top panel. Optionally, the lid may also comprise two first and two second rectangular corner panels, the first corner panels joined to opposite edges of the first end panel and the second corner panels joined to opposite edges of the second end panel (such lid is called a "type 0300" lid as it is shown under item 0300 in said FEFCO/ESBO publication). The lid may be created from the same cardboard as the box or from a different cardboard.

Known systems for creating custom-sized open packaging boxes and corresponding separate closing lids from cardboard being continuously supplied to the systems in particular from stacks from zig-zag folded cardboard, can be set up to produce type 0300 boxes and corresponding lids (both having so called corner panels) or combinations of such boxes with e.g. type 0302 lids (having no corner panels) by first cutting out and creasing a custom-sized blank, from which a box is folded automatically around the shipment set to be packaged after placing the shipment set consisting of one or more of item(s) on the blank. Such systems comprise structure for cutting (which may also include die cutting. i.e. punching out certain parts), like rotating or reciprocating knifes, lasers, die cutters etc., structure for creasing, like crease rollers or moving stamps, structure for folding the cardboard, like moveable grippers and flaps, and structure for attaching the respective panels to each other, like a glue unit for applying hot melt glue to one or both of two overlapping panels. Upon erecting a box, the system would first fold the corner panels upwards, then the end panels upwards and thus the corner panels, which are joined to the end panels, inwards, and finally the side panels upwards.

While the known systems and methods for automating the packaging process work well fora number of applications, and in particular the system disclosed in WO 2014/117817 A1 has proven to allow packaging items varying in size and number fully automatically, it has turned out that there is a need for optimization of the packaging process. For example, using a special box design as disclosed in WO 2019 081773 A1 allows to package about 1000 and even more varying shipment sets per hour, while an important factor limiting the throughput of a respective packaging system is the time a box has to be hold in a station erecting the box in order to allow the glue that is used to fix the panels with respect to each other to set. In automated systems for creating custom-sized boxes (and corresponding lids, if a box design is used that requires a separate lid) using hot melt glue has many advantages for fixing the respective panels forming the box and/or the lid to each other over alternative ways such as using single- or double-sided adhesive tape. Of course, this is not only true for custom-sized cardboard boxes, but for any cardboard box. Hot melt glue can easily be applied by automated "glue guns", i.e. units comprising structure for melting the glue and applying the molten glue onto the panels.

As the panels to be fixed to each other by glue usually are bent onto each other starting from a flat blank of cardboard, the panels have a tendency to return to their original flat position and hence to move away from each other during the gluing process. Hence, while the glue cures, the panels to be glued together have to be kept in a certain fixed relation to each other, which in certain cases, in particular in high-speed packaging systems, can be challenging, in particular when custom-sized cardboard boxes for shipment sets of items not completely filling out a respective cuboid box, for example due to the shape of the items, are created. If for example only a single item of cuboid shape has to be packaged in a box, that fully follows the form of the item to be packaged without leaving substantial room between the outer walls of the item and the inner walls of the box, the item itself can be used to create a counter force towards an outer panel when pressing the outer panel against an inner panel, onto which it shall be glued on the inner panel. However, for packaging varying shipment sets, although the box may be custom-sized, i.e. optimized with respect to different optimization criteria such as volume, stability, etc., it is generally not possible to assume that the items in the box will, if an outer panel of the box is pressed against an inner panel during the gluing process, create sufficient counter-pressure to hold both panels in place.

Different means and measures have been suggested to keep the panels to be glued together in a fixed relation with respect to each other to allow the molten glue to harden, for example more or less complicated mechanical systems of gripping the respective panels and pressing them together, which is particularly challenging when, in order to increase the throughput of a respective system, the boxes shall move during the gluing process or shall be moved as soon as possible after hot melt glue has been applied. It has also been suggested to spread out the glue over a large surface, allowing the glue to cool down quickly and bond the panels together. However, it has turned out that such way of spreading glue over large surfaces is very problematic in high-speed packaging systems.

DISCLOSURE OF THE INVENTION

One object of the invention is to provide a system and a method for forming boxes, in particular but not necessarily custom-sized boxes, from cardboard blanks that allow increasing the speed, in which respective boxes are created.

These and other objects are achieved by a system for automatically forming packaging boxes, the system including: a folding station comprising four folding units to fold panels of cardboard blanks to form substantially cuboid boxes or lids or combinations of a box and a lid, some of said panels in the folded state forming pairs of two panels running substantially parallel to each other in a processing direction, in which the cardboard blanks are transported through the system, and orthogonal to a width direction of the cardboard blanks, which is the orthogonal direction to the processing direction in the plane of the cardboard blanks, one or more glue application units to put glue on at least one panel of each of said pairs of two panels, a feeding conveyor for conveying ones of the cardboard blanks into the folding station, and a curing station adapted to take over the boxes or lids or combinations of a box and a lid folded in the folding station from the folding station, said curing station comprising a holding structure to form-fittingly hold said pairs of panels and to guide the boxes or lids or combinations of a box and a lid through the curing station, said holding structure comprising a first side guiding element and a second side guiding element substantially parallel to the first side guiding element, a distance of the first and second side guiding elements and a distance of the folding units in said width direction being adjustable to different widths of boxes or lids or combinations of a box and a lid to be folded in the folding station, and wherein said first and second side guiding elements are extendable in their length seen in the processing direction. These and other objects are achieved by a method for automatically forming packaging boxes, the method including folding the panels of cardboard blanks to form substantially cuboid boxes or lids or combinations of a box and a lid, some of said panels in the folded state forming pairs of two panels running substantially parallel to each other in a processing direction in which the blanks are transported, and orthogonal to a width direction of the blanks, which is the orthogonal direction to the processing direction in the plane of the blanks, wherein the folding is done in a folding station comprising four folding units arranged to form a pair of rear folding units and a pair of front folding units, the pair of rear folding units being arranged in the processing direction closer to a feeding conveyor, which feeds cardboard blanks to said folding station, than the front folding units, the method further comprising moving at least one of said pairs of folding units towards the curing station for transporting the folded boxes or lids or combinations of a box and a lid into the curing station; prior to folding the panels forming said pairs into a position, in which both panels of a pair run substantially parallel to each other, applying glue on at least one panel of each of said pairs of two panels, transporting the folded boxes or lids or combinations of a box and a lid while form-fittingly holding said pairs of panels into a curing station comprising a holding structure to form-fittingly hold said pairs of panels and for guiding the boxes or lids or combinations of a box and a lid through the curing station, form-fittingly holding said pairs of panels in the curing station allowing the glue to cure and guiding the boxes or lids or combinations of a box and a lid through the curing station, and extending said guiding elements in their length seen in the processing direction. The respective dependent claims relate to advantageous embodiments of the respective independent claims.

A basic concept of the invention is to provide a curing station that takes over erected boxes from a box folding station and holding them in shape sufficiently long to let the glue bond, while freeing the box folding station to start folding another box. It has surprisingly turned out that introducing such curing station can drastically increase the throughput of a system for forming boxes or lids or combinations of a box and a lid. It should be noted that the glue can in principle be any adhesive, while it will typically be hot melt glue, which is easy to handle in automated systems and cures fast. For sake of simplicity, in the following it will be assumed that the glue is hot melt glue and the process in which it hardens and binds those parts, between it is placed, together will be denoted as curing, although the invention is equally useful if other types of glue are used, that may not harden but that will stay soft even when the glue has set. Thus, the invention is not limited to systems using hot melt glue.

The invention allows gluing at high speeds while ensuring that during curing of the glue the parts that are glued together are held against each other, allowing creating strong bonds between the parts. In this respect, it should be noted that the term "part of a box" refers to any part, typically a so-called side panel, of a box that is placed, typically by folding, on another part of the box, typically a corner panel, and attached to that part to form the box. Of course such part of the box can also be the lid. From the disclosure herein, it is obvious that the systems and methods disclosed herein can be applied to open boxes, boxes with attached lids, and lids for boxes, in particular as such lids typically have the same general structure as an open box. A system for automatically packaging shipment sets may comprise two curing stations, of which one is used for holding the side panels of a box in position while the glue cures, while the other is used for holding a lid (on a box or separately) in position while the glue cures.

The curing station may be adaptable in its width to the width of a box being erected.

The curing station may be movable to adapt its entry position to the position where the folding station has erected the box.

The curing station may have transport means for transporting the box through the curing station.

To support boxes of variable length and also to give long boxes sufficient time to let the glue bond, the curing station may comprise lengthwise extendable side guiding elements, i.e. the exit of the curing station may be at a fixed position, while the entry position is dynamically adapted to where the box is picked up.

In one embodiment of the invention, a blank runs into a folding station comprising two front and two rear folding units movably mounted. The front folding units pick up the front side of the blank and move forward until the rear folding units can pick up the rear side of the blank. Once the front folding units have picked up the blank, they start, as described above, folding the front corner panels, then the front end panel and thus the front corner panels inwards, as these panels are joined to the front end panels. Once the rear folding units have picked up the blank, they accordingly start folding the rear corner panels upwards, then the rear end panel upwards and thus the rear corner panels inwards, as these panels are joined to the rear end panels. When the front and the rear end panel are erected, the side panels can be erected. In this embodiment, the end position of the rear end panel is fixed. The end position of the front end panel depends on the length of the box. The curing station adapts its entry position to the front folding units, i.e. the front side of the box. The curing station is in position when the box is set-up. The box can then be transferred into the curing station "on the fly", i.e. with continuous support of the panels just glued together.

In another embodiment of the invention, the curing station's entry position is fixed. When setting up the box the front folding units move to the entry of the curing station. The position of the rear folding units depends on the length of the box. When the box is set-up and the folding units are in position, the box is transferred into the curing station. Depending on the distance between the rear and front folding units (i.e. the size of the box), the rear folding units can push the box into the curing station. When the rear folding units are adjacent to the front folding units, another transport means can take over the transport of the box fully into the curing station, for example a slider pushing the box forward.

In another embodiment of the invention, the ideas of both aforementioned embodiments are combined, but with the travel distance of the folding units minimized and creating some distance that the next blank may run in the folding station while the current box is transported away. The curing station's entry position is adapted to the size of the box. Depending on the size of the box, the rear folding units push the box into the curing station. The front folding units start returning to their starting position, i.e. the position for receiving and processing a new blank, once the transfer of the box into the curing station is started, during which the side flaps of the front folding unit keep the side panels in place. The curing station follows the front folding units in their reverse direction, during which the curing station takes over the box. The rear folding units will reverse their movement in time to avoid that the already moving front folding units run onto them.

The invention is especially applicable in high speed packaging systems with a short cycle time where there is little time to set-up each box and ensure that it is properly glued.

This idea is especially relevant when the shipment sets forming the contents of the boxes vary and do not fill up the respective box completely, or are of a soft nature, i.e. when the item(s) forming a shipment set do not provide sufficient counter pressure from within the respective box when the box is set-up.

Further details and advantages of the invention will become apparent from the following detailed description of embodiments in conjunction with the drawing, which comprises 14 drawing figures.

DESCRIPTION OF PREFERRED EMBODIMENTS

Figure 1:
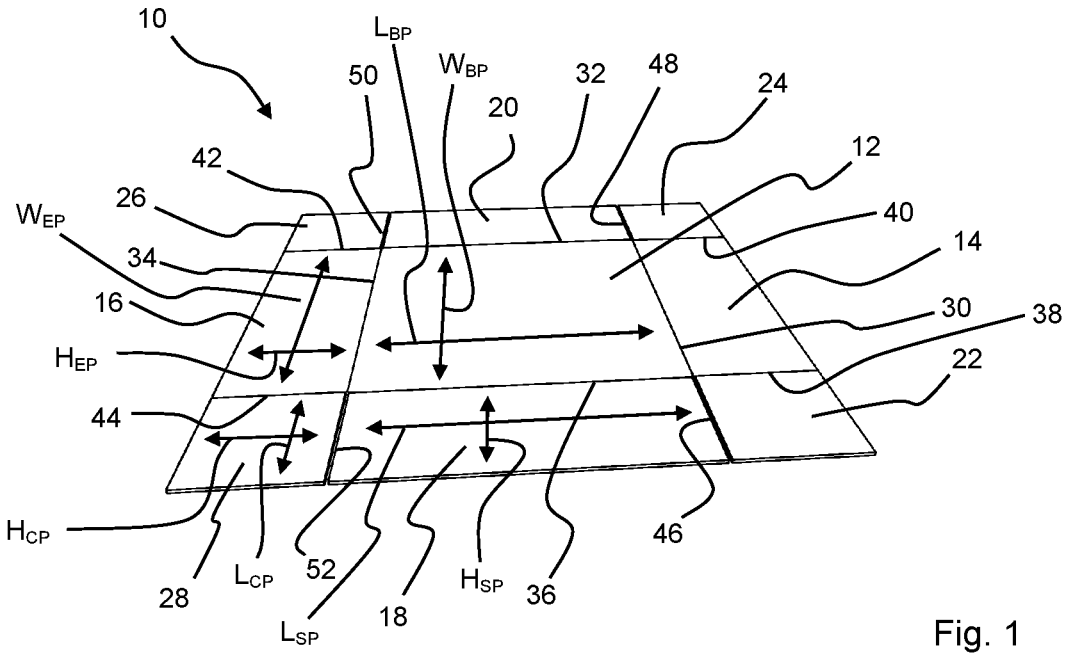
FIG. 1 is a perspective view of a cardboard blank for folding an open box.
Figure 2:
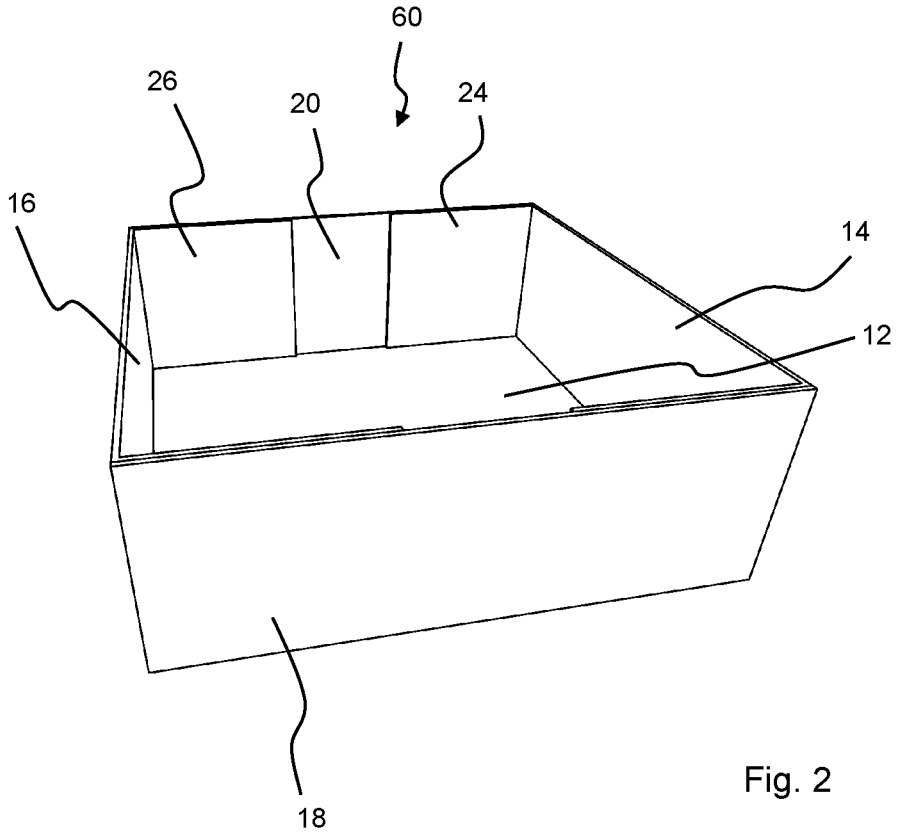
FIG. 2 is a perspective view of a box folded from the blank shown in FIG. 1.

FIG. 1 shows a blank 10 fora type 0300 box, having a bottom panel 12, a first end panel 14, a second end panel 16, a first side panel 18, a second side panel 20, two first corner panels 22 and 24 joined to opposite edges of the first end panel 14 and two second corner panels 26 and 28 joined to opposite edges of the second end panel 16. The panels are delimited against each other via eight crease lines 30-44 respectively four slots 46, 48, 50 and 52. The crease lines 38 and 44 are with respect to the crease line 36 slightly shifted, namely to an amount corresponding to the thickness of the cardboard towards the first end panel 14 respectively the second end panel 16. Likewise, the crease lines 40 and 42 are shifted in an amount corresponding to the thickness of the cardboard towards the first end panel 14 respectively towards the second end panel 16 with respect to the crease line 48. Thus, the width $W_{EP}$ of the end panels 14 and 16 is slightly less than the width $W_{BP}$ of the bottom panel 12. This allows that in the erected state as shown in FIG. 2, the corner panels 22 and 28 run perfectly parallel to the side panel 18 and the corner panels 24 and 26 run parallel to the side panel 20.

Shifting the crease lines 38 and 44 with respect to the crease line 36, and shifting the crease lines 40 and 42 with respect to the crease line 32 also leads to the fact that the length $L_{CP}$ of the corner panels is to the amount of shifting greater than the height $H_{SP}$ of the side panels.

The slots 46, 48, 50 and 52 are also dimensioned to take into account the thickness of the cardboard: the height $H_{CP}$ of the corner panels has to be decreased by the thickness of the cardboard as in the erected state these corner panels abut against the bottom panel while the top side of the corner panels shall, in this type of box, be level with the top end of the end panels. The height $H_{EP}$ of the end panels 14 and 16 corresponds to the height $H_{SP}$ of the side panels 18, 20, which in this type of box defines the maximum height of the box. However, the invention is not limited to this type of boxes, but can for example also be used with boxes such as the ones disclosed in WO 2019 081773 A1 or other types.

Due to the material inherent properties, the slots are typically not made such that only the height Hop of the cornel panels is shortened, but also the length $L_{SP}$ of the side panels, which facilitates erecting the box and ensures that the side panels do not extend beyond the end panels in the erected state. Hence, the length $L_{SP}$ of the side panels 18, 20 is typically a bit shorter than the length $L_{BP}$ of the bottom panel 12. As stated above, the first end panel 14 is considered here to be the front end panel, that is the panel that forms the front of the blank in the processing direction, in which it is transported through the system for creating boxes, whereas the second end panel 16 forms the rear end in that direction and is accordingly called rear end panel. Likewise, the first corner panels 22 and 24 are called front corner panels, whereas the second corner panels 26 and 28 are called rear corner panels.

Figure 3:
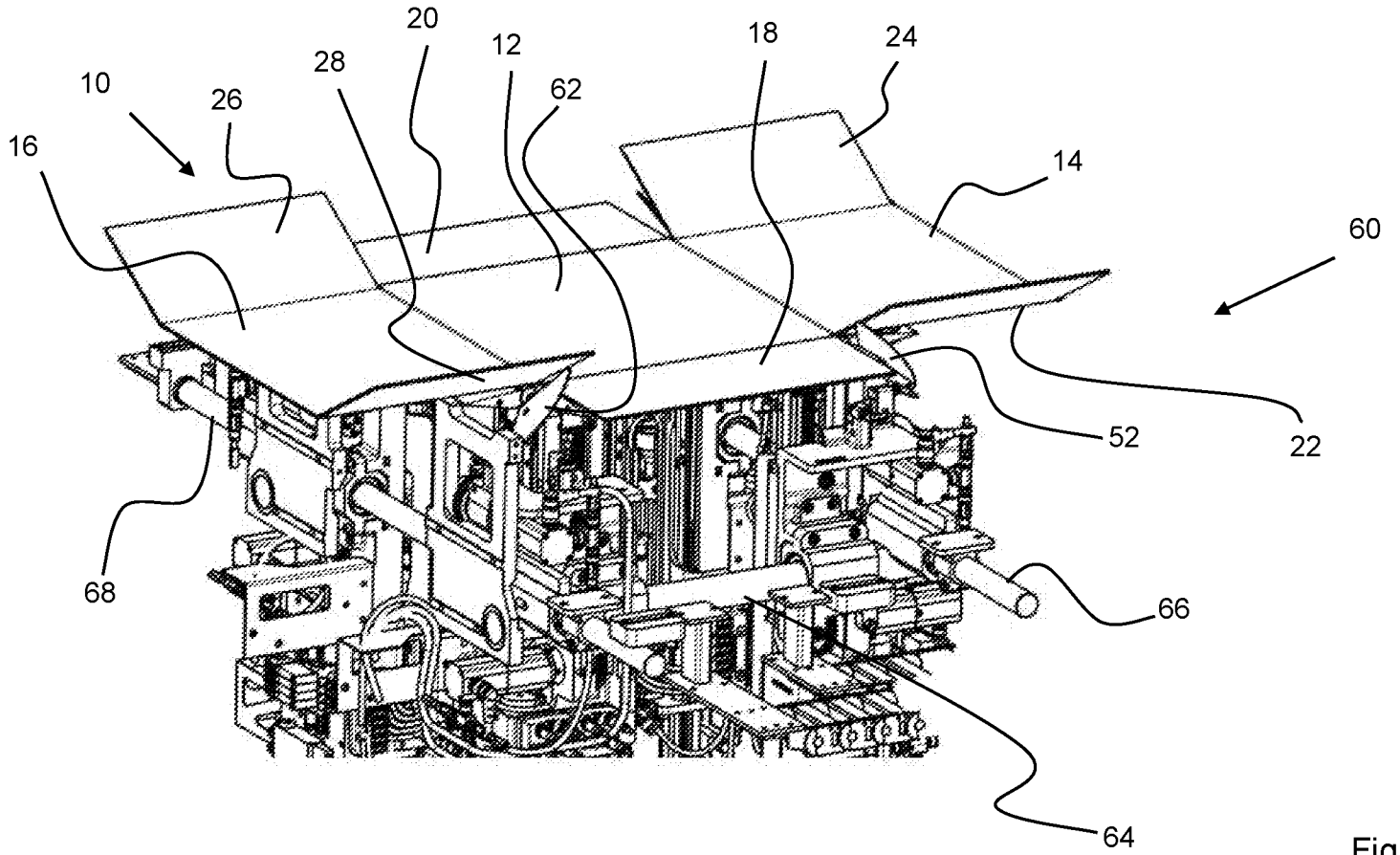
FIG. 3 shows some parts of a folding station for folding cardboard blanks.

FIG. 3 shows schematically some parts of a folding station 60 according to the prior art for folding cardboard blanks like the blank 10 shown as one example in FIG. 3 to form packaging boxes. The blank 10 has a slightly different layout than the blank shown in FIGS. 1 and 2 (the height of the end panels 14 and 16 is greater than the height of the side panels 18 and 20), but both and other layouts may equally be treated according to the invention.

The folding station 60 shown comprises four folding units, each comprising a corner panel folding element 62, of which in the shown situation, in which a cardboard blank 10 has been placed on the folding station and the corner panel folding elements 62 have started to push the corner panels 22, 24, 26 and 28 upwards, only two are visible.

The folding units are slidably mounted on rods 64, 66 and 68 in order to be moveable in a plane parallel to the plane of the cardboard blank 10, as the cardboard blanks to be folded may in this embodiment differ in size and hence the positions of the panels of the cardboard blank to be folded by the folding station 60 may vary from blank to blank.

The shown folding station 60 is of exemplary nature to facilitate understanding the folding process. In a preferred embodiment, at least the front folding units, which come first into contact with a blank to be folded, are movable so that they can be moved towards a curing station.

The folding station 60 forms part of an automatic packaging system, in which custom sized boxes can be created from cardboard fed into the system usually from zig-zag folded stacks of cardboard and in which items to be shipped are automatically packaged in the boxes formed. Such system is disclosed for example in WO 2014/117817 A1. Such automatic packaging system comprises a blank forming apparatus, in which the cardboard is cut and creased to form a custom sized blank, which then can be folded automatically.

Figure 4:
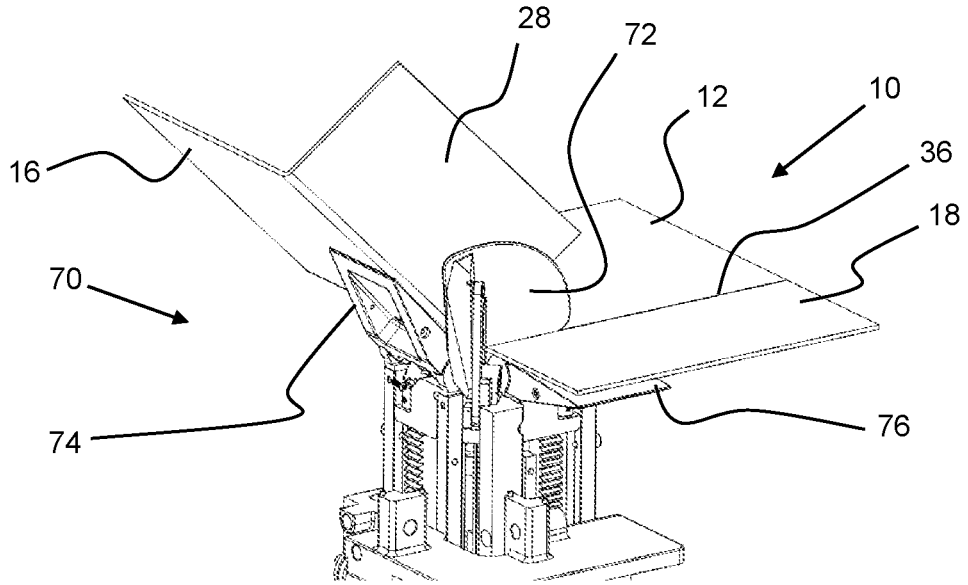
FIG. 4 shows a folding unit of a folding station according to FIG. 3.

FIG. 4 depicts the upper part of a folding unit 70, which advantageously may be movable in two directions, namely in (and against) a processing direction, in which cardboard blanks and then, once folded, boxes are transported through the system, and in (and against) the width direction of the blanks processed, which is the orthogonal direction to the processing direction in the plane of the blanks. As will be explained later, being movable in the processing direction (and against it to return to a starting position) allows both folding blanks of different lengths and guiding the blanks resp. the boxes folded thereof towards a curing station, and being movable in and against the width direction allows, if necessary, to fold blanks of different widths.

A corresponding folding station typically comprises four such folding units adapted to fold the four corner panels, the two front and rear end panels and the two side panels of a box (or a lid) to be created. FIG. 4 also shows a portion of a blank 10, namely a part of a bottom panel 12, a part of a side panel 18, a part of a rear end panel 16, and a corner panel 28. The folding unit 70 exemplarily shown in FIG. 4 is adapted to fold the rear corner panel 28 upwards, the rear end panel 16 upwards and the side panel 18 upwards. For doing so, the folding unit 70 comprises a corner panel folding element with an actuable guiding plate 72, a blank fixing element (not visible) for fixing the bottom panel 12 in position during folding the panels attached to the bottom panel 12, an end panel folding element 74 and a side panel folding element 76. The fixing element may be implemented in form of an elastic suction cup, which is connected with means for evacuating air from the suction cup so that the surrounding air pressure would press a corresponding panel placed on the fixing element to the fixing element. Depending on the specific implementation of the folding unit, such fixing element may not be necessary, for example when the folding unit is used to fold panels upward after items to be packaged have been placed on a bottom panel of a cardboard blank. Depending on the form and weight of the items, the items may fix the blank sufficiently while the side and end panels and also the corner panels attached to the end panels are being folded. However, the presence of a fixing element makes the folding of boxes with only low weight items more reliable.

In the embodiment shown in FIG. 4, the guiding plate 72 has substantially the shape of a quarter circle with rounded corners. In the end position of its movement, one of its edges runs substantially along an end portion of the crease line 36 between the bottom panel 12 and the side panel 18. During movement of the end panel 16, the flat surface of the guiding plate 72 will guide the respective corner panel 28 attached to the rear end panel 16.

In the situation shown in FIG. 4, guiding plate 72 is still in contact with corner panel 28, which slides along the guiding plate 72 as the end panel 16 is pushed upwards by end panel folding element 74. As the end panel folding element 74 has started pushing end panel 16 upwards, also corner panel 28 attached to it has moved upwards while being guided by guiding plate 72 to its final position approximately against crease line 36. In the shown situation, hot melt glue (not shown) will be or may have already been applied to a portion of the side panel 18 that in the final folding state comes into contact with corner panel 28. Similarly, the other corner panels will be glued to the side panels. Hitherto, the panels had to be held in place during curing of the hot melt glue by the respective side panel folding elements, thus that the folding units were blocked from processing a new blank. The invention now advantageously frees the folding units from this task.

FIGS. 5 to 10 show very schematically different stages during operation of a system according to the invention, which may be used as part of a system for automatically packaging varying shipment sets in (open) boxes, which are closed separately, but which may also be used to produce lids, empty boxes or to place and glue lids onto filled boxes (in case of which of course the panels would not, as shown, be folded upwards but downwards). A system for automatically packaging varying shipment sets that employs the system shown in FIGS. 5 to 10 will—as described in the prior art mentioned above—comprise means like laser scanners for obtaining information on the overall length, width and height dimensions of a shipment set to be packaged and means like a computer for calculating, based on said information, the layout of a cardboard blank. The system will further comprise, as mentioned above, structure for cutting and creasing cardboard to have the calculated layout and an input conveyor for conveying the shipment set onto the bottom panel at least prior to folding the rear corner panels.

The system shown in FIGS. 5 to 10 comprises a feeding conveyor 80 for feeding a cardboard blank 10 in a processing direction 82 into a folding station that in this case comprises four folding units folding arranged in pairs forming a pair of rear folding units, of which one folding unit 70 is visible, and a pair of front folding units, of which one folding unit 84 is visible. In the shown example, the pairs of folding units are movable relative to each other.

The system also comprises one or more glue application units (not shown in these schematic drawings as these drawings are intended to show the principle of employing a a curing station) for applying glue on at least one of the panels of the blank 10 that are to be glued together and a curing station formed by a base 86 and holding structure to take over the boxes or lids or combinations of a box and a lid formed at the folding station and to guide them through the curing station while form-fittingly holding the panels that are glued together allowing the glue to cure. The glue application unit may be adapted to apply portions of hot melt glue with at least two different surface-to-volume ratios, which can contribute to speeding up the whole process as the portions having a higher surface to volume ratio may cure faster and thus fix the panels provisionally, while the other portion may contain more glue and may lead, once cured, to a stronger bond.

Of the holding structure, which supports, seen in the processing direction, the sides and the bottom of—in this case an open—box, a first side guiding element 88 is visible in these schematic drawings, while a second side guiding element substantially parallel to the first side guiding element 88 is provided. The distance of the side guiding elements and the distance of the folding units in the width direction, which is the direction orthogonal to the processing direction 82 in the plane of the blank 10, are adjustable to different widths of boxes or lids or combinations of a box and a lid to be folded in the folding station. The side guiding elements 88 may for example be formed by panels or arrangements of rods and may be extendable in their length seen in the processing direction 82.

The system further comprises a transport device (not shown) for transporting the box fully into and through the curing station.

Figure 5:
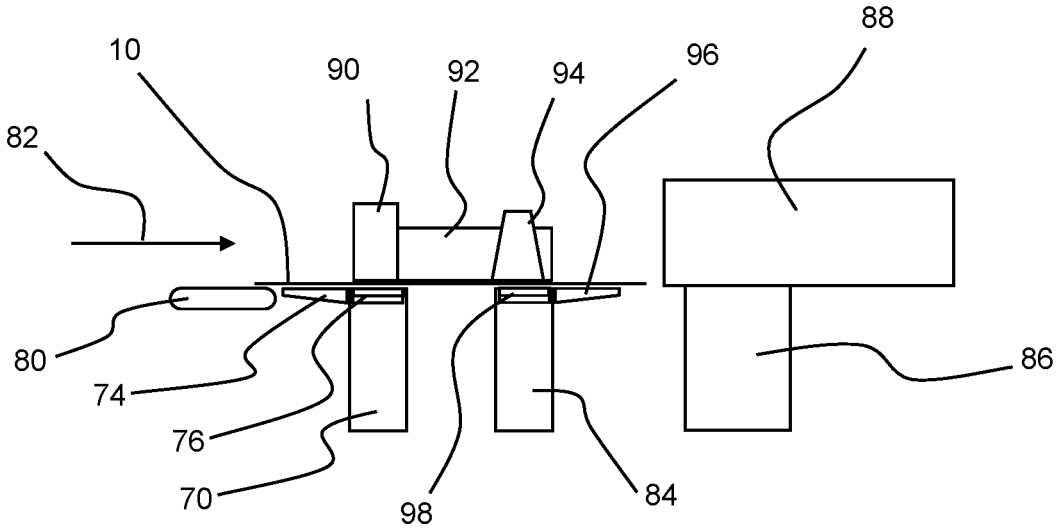
FIGS. 5 to 10 show very schematically different stages during operation of a system according to the invention.

In the situation shown in FIG. 5, some items 90, 92, 94 forming a shipment set have been placed on blank 10, either before or after handing over the blank from the feeding conveyor 80 to the folding station, and placing may be done manually or automatically, but as mentioned, the system and in particular the curing station may also be used within other configurations, for example in systems, where no items are handled.

Figure 6:
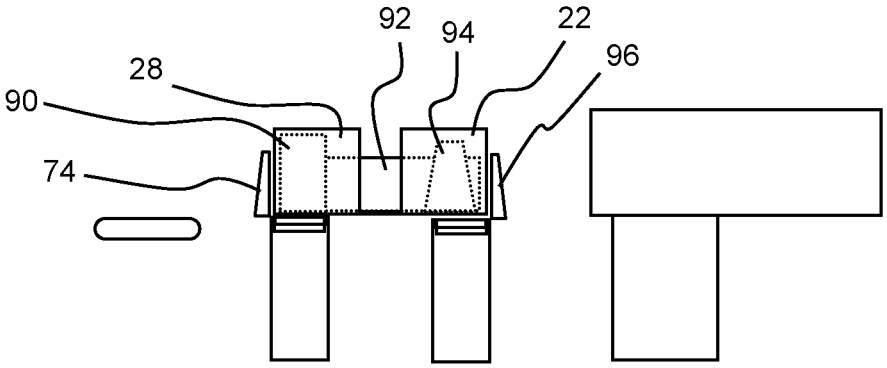

Each folding unit 70, 84 comprises a cornel panel folding element (not shown in these schematic drawings), a blank fixing element (also not shown), an end panel folding element 74, 96 and a side panel folding element 76, 98. In a first step of the folding process according to this example, the front and rear corner panels 22, 28 and the front and rear end panels are erected as shown in FIG. 6. In FIG. 6, the parts of the items 90, 92, 94 that are no longer visible due to folding up the corner panels are shown in dotted lines.

Figure 7:
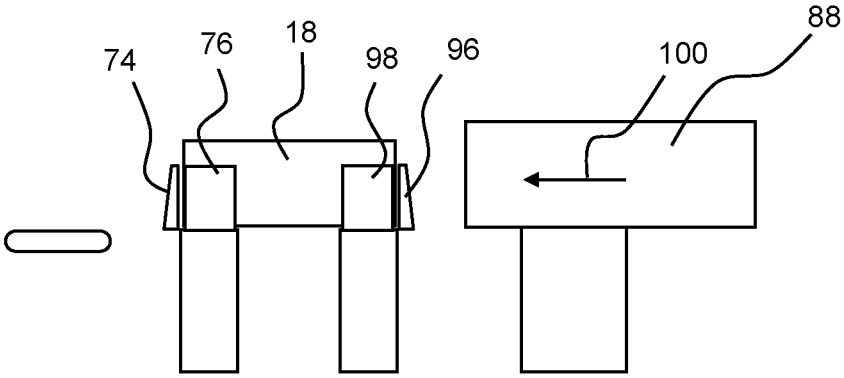

Next, the side panels, of which only side panel 18 is visible, are erected as shown in FIG. 7 by the side panel panel folding elements 76 and 98, thus an open box is formed. For sake of simplicity, the items in the box are no longer indicated. Prior to folding the side panels onto the respective corner panels, hot melt glue has been applied on at least one of the panels to be glued together. This may already have been done upon transferring the blank into the folding station.

As indicated by arrow 100, the holding structure of the curing station, of which only side guiding element 88 is visible in FIG. 7, has started moving towards the folding station to take over the box.

Figure 8:
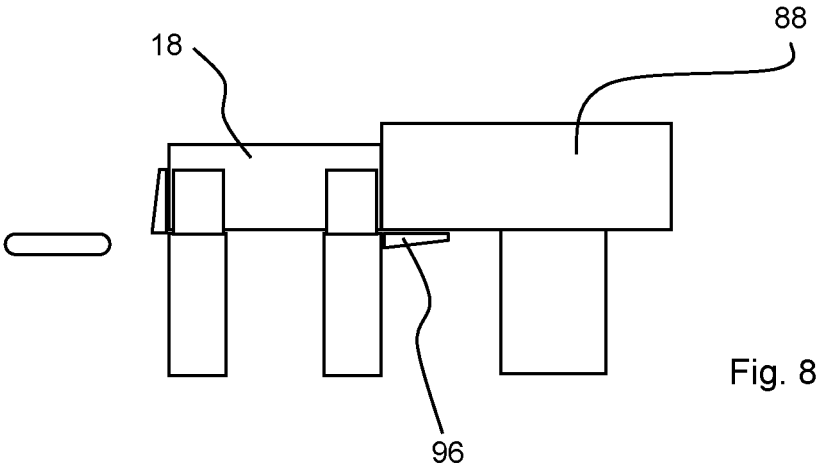

FIG. 8 depicts the situation in which the holding structure with side guiding element 88 has arrived at a position for taking over the box from the folding station. In order to do so, the front end panel folding elements, of which only element 96 is visible in FIG. 8, have returned to their initial position. Separate means not shown in FIG. 8 may be provided to take over the support of front panel 14 to prevent it from leaving its straight-up position allowing the hot melt glue to cure.

Figure 9:
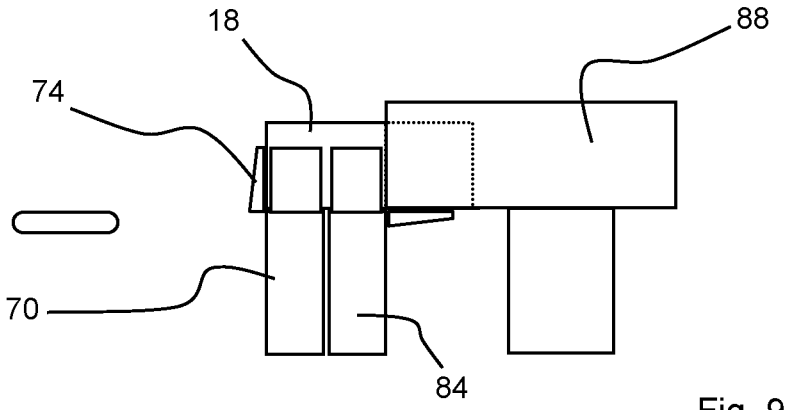

FIG. 9 depicts the situation in which the box has already been partially handed over to the curing station, such that the side guiding elements contact a portion of the respective side panels and hold them in place allowing the hot melt glue to cure. In FIG. 9, the dotted lines indicate the portion of side panel 18 that has already been moved into the curing station, i.e. between the elements forming the holding structure. The movement of the box is caused by a respective movement of the rear folding units, of which only unit 70 is visible in FIG. 9, towards the front folding units, of which only unit 84 is visible here, and thus towards the holding structure. As the rear end panel folding elements, of which only element 74 is visible here, are still in their upright (or folding) position, they abut against the box just formed and push it into the curing station when the rear folding units move towards that station.

Figure 10:
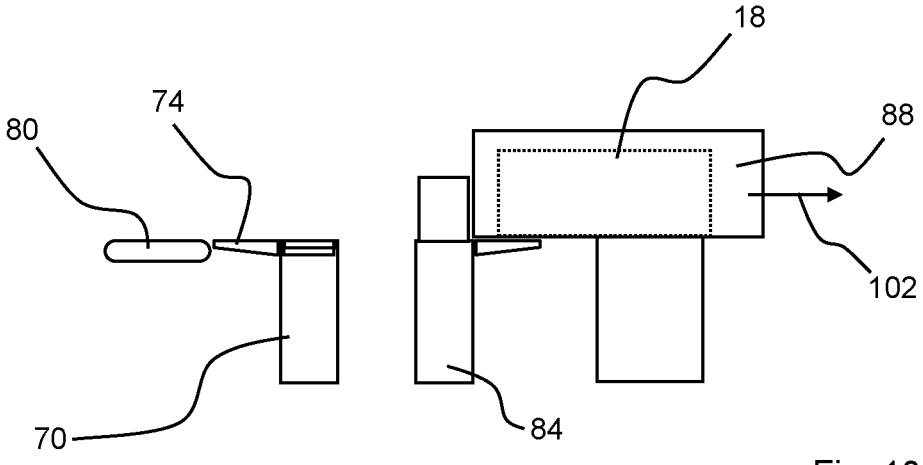

FIG. 10 depicts the situation in which the box is fully in the curing station, such that the side guiding elements contact the respective side panels and hold them in place allowing the hot melt glue to cure. The rear folding units, of which only unit 70 is visible here, have returned to their starting position next to feeding conveyor 80. The rear end panel folding elements, of which only element 74 is visible here, have returned to their initial position allowing a next blank to be moved onto them. The holding structure, of which only side guiding element 88 is visible here, will start returning as indicated by arrow 102 towards its initial position, where a box can be pushed or otherwise transported out of the curing station for further processing such as (if not yet done) labelling and/or franking and/or transporting towards a lid placing station to place a lid on the box. Transporting the box fully into and through curing station may be done by a suitable transport device such as one or more movable fingers pushing the box or revolving rubber and/or vacuum belts integrated in the holding structure and pulling the box through the curing station.

While in the shown embodiment both, the rear end folding units and curing station, here in particular the holding structure, are movable in and against the processing direction, other configurations are possible. For example, the rear folding units may stay in a fixed position, while the front folding units move in and against the processing direction in order to adapt to blanks of different lengths, and the curing station may move towards the front folding units for picking up a box. Likewise, all three, the rear folding units, the front folding units and the curing station may be movable in and against the processing direction in order to optimize the throughput of a respective system by freeing the folding units as early as possible for handling a next blank while ensuring sufficient support of the current box to allow the glue to cure.

In a specific embodiment the front folding units 84 may start to move back towards the feeding conveyor 80 as soon as the box has been set-up, the front end panel folding elements 96 have been lowered and the side guiding elements 88 are in position adjacent to the front folding units 84 to take over the box. The side panel folding elements 98 of the front folding units 84 are still up to support the side panels 18, 20 of the box. While the front folding units move back towards the feeding conveyor, the movable side guiding elements 88 of the curing station follow the front folding units until the box has been fully moved into the curing station, such that there is a continuous form-fit support of the box by either the folding units or the curing station. The rear folding units 70 will stop transporting the box into the curing station and also start to move back towards the feeding conveyor before the front folding units reach the rear folding units and a collision of the folding units would occur. From the disclosure, it is apparent that the timing of the front folding units, the rear folding units and the guiding elements in this embodiment depends on the length of the box created.

Figure 11:
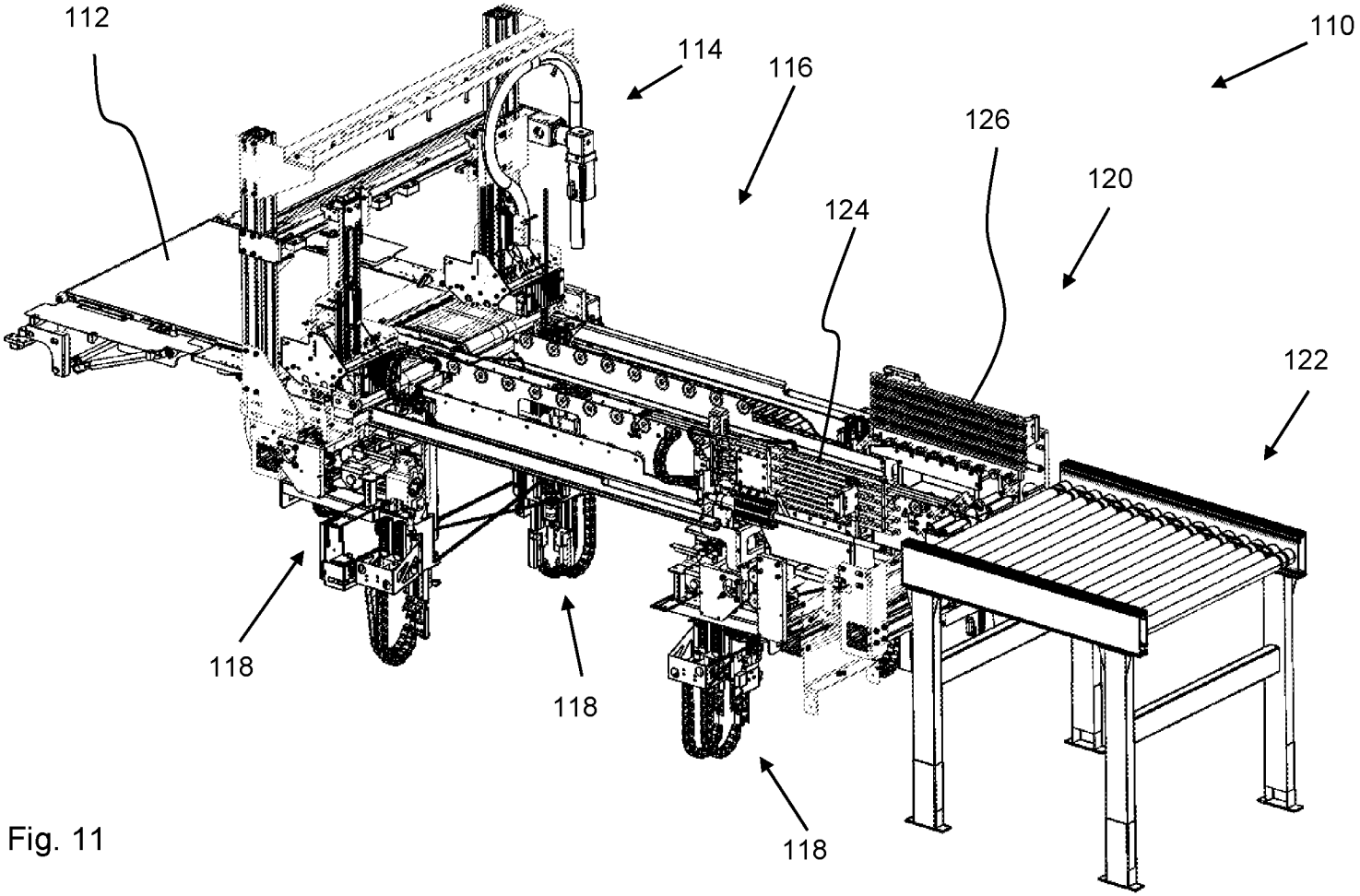
FIG. 11 shows parts of a system for automatically packaging varying shipment sets in custom-sized cardboard boxes.

FIG. 11 shows parts of a system 110 for automatically packaging varying shipment sets in custom-sized cardboard boxes, namely an input or assembly station 112, where during operation shipment sets are placed on a custom-sized cardboard blank having a layout as described above, a glue application station 114, where glue is applied to parts of the side panels of the blank that will come in to contact with the respective corner panels, a folding station 116 comprising four folding units 118 adjustable in their position to handle differently sized blanks, a curing station 120 and a pick-up station 122, where the final folded boxes arrive when the glue has cured and are picked-up for further processing. The curing station 120 comprises holding structure for form-fittingly holding the side panels of a box erected in the folding station 116 and for guiding the boxes through the curing station. The holding structure comprises in particular two side guiding elements 124, 126 that are substantially parallel to each other while the distance between them is adjustable to different box widths.

Figure 12:
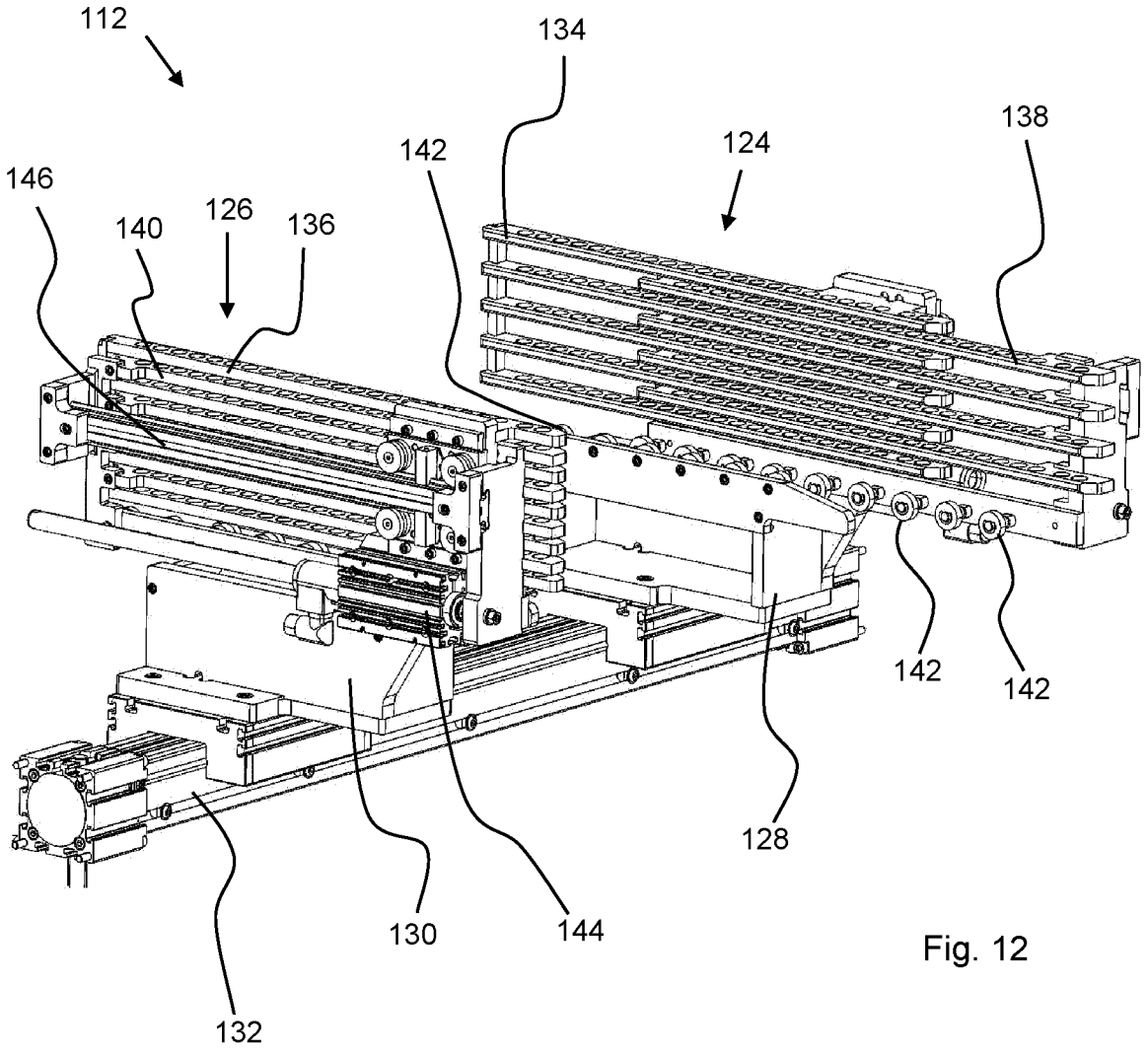
FIG. 12 shows parts of a curing station according to one embodiment of the invention.

FIG. 12 shows parts of a curing station 112 in more detail. It comprises two side guiding elements 124, 126 movably mounted via blocks 128, 130 on a rail 132 such that the distance between them is adjustable to different box widths. In use, the side guiding elements 124, 126 synchronously move in opposite directions along the rail, i.e. towards to or away from each other, such that there is a fixed center line.

In this embodiment, the side guiding elements are extendable in their length seen in the processing direction. To this purpose, each side guiding element 124, 126 has a fixed part 134, 136 and a movable part 138, 140, each part being formed by an assembly of parallel guide bars. Both, the fixed and the movable parts comprise a number of support rollers 142, of which for sake of clarity only some have been provided with reference numbers. The support rollers 142 carry the boxes when they are being transported through the curing station 112. As they are present on both, the fixed and the movable parts, support for the bottom of a box is provided throughout the curing station 112.

In order to facilitate understanding the functioning of the extendable side guiding elements, element 124 is shown in a position, in which the movable part 138 has been moved to a partially extended position, in which it extends the length of the side guiding element 124, while movable part 140 is in a non-extended position. During operation of the curing station, the movable parts 138, 140 would be moved (if extending the side guiding elements 124, 126 is desired) synchronously by a respective linear motor 144 along a respective guide rail 146. The advantage of extendable side guiding elements is that they can provide support over a longer distance so that longer boxes can be supported. In other words, long boxes can be supported over their full length with a curing station having side guiding elements that are in the non-extended position shorter than the respective boxes.

Figure 13:
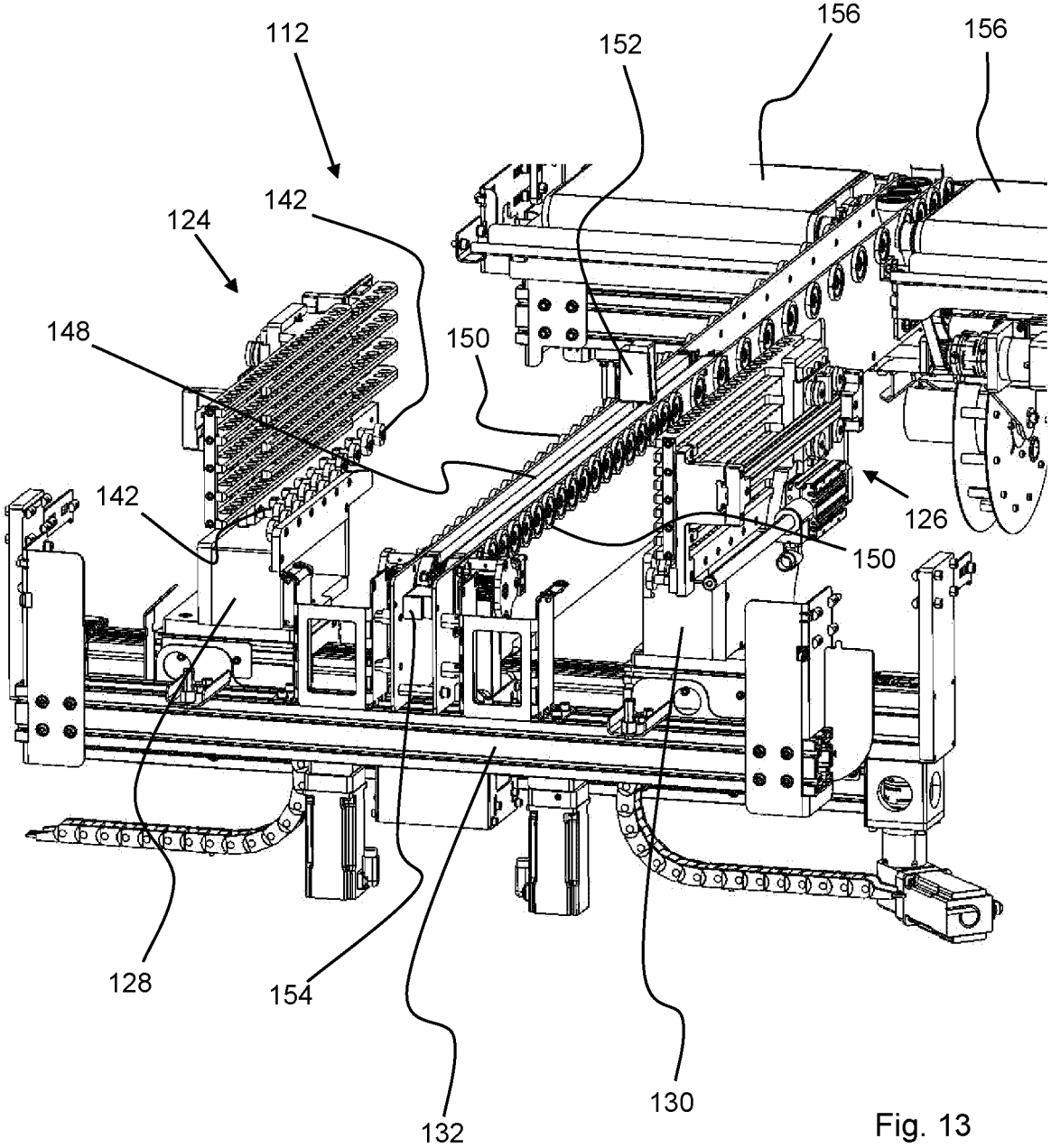
FIG. 13 shows parts of a curing station according to one embodiment of the invention.

FIG. 13 shows a curing station 112 similar to that of FIG. 12, but from a different perspective. The same reference numbers as in FIG. 12 are used for similar parts. In this embodiment, a central track 148 with rows of support rollers 150 on both sides is provided. For sake of clarity, only two support rollers 150 are provided with reference numbers. For sake of clarity also the folding station 116 with folding units 118 as shown in FIG. 11 are left out of this drawing.

The central track 148 accommodates a transport chain having one or more transport fingers 152, 154 which are adapted to push boxes handed over from a folding station, of which only parts like for example conveyors 156 are shown, through the curing station 112. The transport chain may have two revolving fingers and may be configured so that when one of the fingers moves with a box through the curing station, the other finger moves back at the bottom side of the chain. Advantageously, two independently controllable transport chains with one or more fingers may be provided, one chain adapted to push a box through the curing station by pressing with a finger against the rear end panel of the box, while the other may be adapted to provide support for the front end panel of the box during its transport through the curing station.

When two independently controllable transport chains each with one or more fingers are provided, the system may be configured such that the finger that pushes a box through the curing station will support the front side of the next box. In such configuration, the finger may stop at the end of the curing station, when it has pushed the current box out of the curing station, and may then return to a position near the entry of the curing station, where it can contact and support the front end panel of the next box. It may then move with that box through the curing station, turn at the end of track 148 by about 90° around an end of the track to allow the box to be pushed out of the curing station. Finger 156 is shown in such position. Depending on the configuration of the transport chains and the track, the finger may then be moved above or underneath track 148 to the entry of the curing station 112 for pushing the next box through the station.

LIST OF REFERENCE NUMBERS

10 blank
12 bottom panel
14 first end panel (front end panel)
16 second end panel (rear end panel)
18 first side panel
20 second side panel
22, 24 first corner panels (front corner panels)
26, 28 second corner panels (rear corner panels)
30-44 crease lines
46-52 slots
60 folding station
62 corner panel folding element
64 rod
66 rod
68 rod
70 rear folding unit
72 guiding plate
74 end panel folding element
76 side panel folding element
74 rear end panel folding element
76 side panel panel folding element
80 feeding conveyor
82 processing direction
84 front folding unit
86 base
88 side guiding element
90 item
92 item
94 item
96 front end panel folding element
98 side panel panel folding element
100 arrow indicating movability
102 arrow indicating movability
110 system for automatically packaging varying shipment sets
112 assembly station
114 glue application station
116 folding station
118 folding unit
120 curing station
122 pick-up station
124 side guiding element
126 side guiding element
128 block
130 block
132 rail
134 fixed part
136 fixed part
138 movable part
140 movable part
142 support roller
144 linear motor
146 guide rail
148 track
150 support roller
152 transport finger
154 transport finger
156 conveyor
$H_{CP}$ height of the corner panels
$H_{EP}$ height of the end panels
$H_{SP}$ height of the side panels
$L_{BP}$ length of the bottom panel
$L_{CP}$ length of the corner panels
$L_{SP}$ length of the side panels
$W_{BP}$ width of the bottom panel
$W_{EP}$ width of the end panels

The invention claimed is:

1. A system for automatically forming packaging boxes, the system comprising:

a folding station comprising four folding units to fold panels of cardboard blanks to form substantially cuboid boxes or lids or combinations of a box and a lid, some of said panels in the folded state forming pairs of two panels running substantially parallel to each other in a processing direction, in which the cardboard blanks are transported through the system, and orthogonal to a width direction of the cardboard blanks, which is the orthogonal direction to the processing direction in the plane of the cardboard blanks, one or more glue application units to put glue on at least one panel of each of said pairs of two panels, a feeding conveyor for conveying ones of the cardboard blanks into the folding station, a curing station adapted to take over the boxes or lids or combinations of a box and a lid folded in the folding station from the folding station, said curing station comprising a holding structure to form-fittingly hold said pairs of panels and to guide the boxes or lids or combinations of a box and a lid through the curing station, said holding structure comprising a first side guiding element and a second side guiding element substantially parallel to the first side guiding element, a distance of the first and second side guiding elements and a distance of the folding units in said width direction being adjustable to different widths of boxes or lids or combinations of a box and a lid to be folded in the folding station, and wherein said first and second side guiding elements are extendable in their length seen in the processing direction.

2. The system of claim 1, wherein the folding units are arranged to form a pair of rear folding units and a pair of front folding units, the pair of rear folding units being arranged in the processing direction closer to the feeding conveyor than the front folding units, said pairs of folding units being movable relative to each other.

3. The system of claim 1, said holding structure and at least one of said pairs of folding units being movable relative to each other.

4. The system of claim 1, wherein said first and second side guiding elements are formed by panels or arrangements of rods.

5. The system of claim 1, further comprising a transport device operable to transport the box into and/or through the curing station.

6. The system of claim 1, wherein said at least one glue application unit applies portions of hot melt glue with at least two different surface-to-volume ratios.

7. A method for automatically forming packaging boxes comprising:

folding the panels of cardboard blanks to form substantially cuboid boxes or lids or combinations of a box and a lid, some of said panels in the folded state forming pairs of two panels running substantially parallel to each other in a processing direction in which the blanks are transported, and orthogonal to a width direction of the blanks, which is the orthogonal direction to the processing direction in the plane of the blanks, wherein the folding is done in a folding station comprising four folding units arranged to form a pair of rear folding units and a pair of front folding units, the pair of rear folding units being arranged in the processing direction closer to a feeding conveyor, which feeds cardboard blanks to said folding station, than the front folding units, the method further comprising moving at least one of said pairs of folding units towards the curing station for transporting the folded boxes or lids or combinations of a box and a lid into the curing station;

prior to folding the panels forming said pairs into a position, in which both panels of a pair run substantially parallel to each other, applying glue on at least one panel of each of said pairs of two panels, transporting the folded boxes or lids or combinations of a box and a lid while form-fittingly holding said pairs of panels into a curing station comprising a holding structure to form-fittingly hold said pairs of panels and for guiding the boxes or lids or combinations of a box and a lid through the curing station, form-fittingly holding said pairs of panels in the curing station allowing the glue to cure and guiding the boxes or lids or combinations of a box and a lid through the curing station, and extending said guiding elements in their length seen in the processing direction.

8. The method of claim 7, comprising moving said holding structure and said folding station relative to each other.

9. The method of claim 7, said holding structure comprising a first side guiding element and a second side guiding element substantially parallel to the first side guiding element, the method further comprising adjusting the distance of the side guiding elements and the distance of the folding units in said width direction to different widths of boxes or lids or combinations of a box and a lid to be folded in the folding station.

* * * * *